US005132597A

United States Patent [19]

Goebel et al.

[11] Patent Number: 5,132,597

[45] Date of Patent: Jul. 21, 1992

[54] HOLLOW CATHODE PLASMA SWITCH WITH MAGNETIC FIELD

[75] Inventors: Dan M. Goebel, Tarzana; Robert L. Poeschel, Thousand Oaks; Robert W. Schumacher, Woodland Hills; Julius Hyman, Jr., Los Angeles, all of Calif.

[73] Assignee: Hughes Aircraft Company, Los Angeles, Calif.

[21] Appl. No.: 675,584

[22] Filed: Mar. 26, 1991

[51] Int. Cl.[5] ..... H01J 11/04

[52] U.S. Cl. ..... 315/344; 315/338; 315/111.41; 313/161; 313/359.1

[58] Field of Search ..... 315/111.21, 111.41, 315/338, 340, 344; 250/426; 313/161, 231.31, 359.1

[56] References Cited

U.S. PATENT DOCUMENTS

| | | | |
|---|---|---|---|
| 3,719,893 | 3/1973 | dePackh | 313/161 |
| 4,596,945 | 6/1986 | Schumacher | 315/344 |
| 5,019,752 | 5/1991 | Schumacher | 315/344 |

OTHER PUBLICATIONS

H. Kaufman, "Technology of Electron-Bombardment Ion Thrusters", Advances in Electronics and Electron Physics, ed. by L. Marton, vol. 36, Academic Press, 1974, pp. 266-373.

D. M. Goebel et al., "Rectangular Area Hollow Cathode Ion Sources":, Proceedings of the Third Neutral Beam Heating Workshop, Oct. 19-23, 1981, pp. 35-42.

D. M. Goebel et al., "Plasma Studies on a Hollow Cathode, Magnetic Mulitpole Ion Sourch for Neutral Beam Injection", Rev. Sci. Instrum., vol. 53, No. 6, Jun. 1982, pp. 810-815.

C. C. Tsai et al., "Plasma Studies on a DuoPIGatron Ion Source", Rev. Sci. Instrum., vol. 48, No. 6, Jun. 1977, pp. 651-655.

H. J. King et al., "Electron-Bombardment Thrusters Using Liquid-Mercury Cathodes", J. Spacecraft and Rockets, vol. 4, No. 5, May 1967, pp. 599-602.

*Primary Examiner*—Eugene R. LaRoche
*Assistant Examiner*—Michael B. Shingleton
*Attorney, Agent, or Firm*—V. D. Duraiswamy; W. K. Denson-Low

[57] ABSTRACT

A diverging magnetic field is established between the cathode and control electrode of a hollow cathode plasma switch to expand the plasma at a passageway through the control electrode, thus significantly increasing the switch's current handling capability. Preferred ranges of magnetic field strength, gas pressure, spacing between the hollow cathode and control electrode, and the mesh aperture size for the control grid are described.

25 Claims, 5 Drawing Sheets

HOLLOW CATHODE PLASMA SWITCH WITH MAGNETIC FIELD

RELATED APPLICATION

This application is related to pending U.S. application Ser. No. 07/406.673, filed Sept. 13, 1989 by Robert W. Schumacher et.al., "Plasma Switch With Hollow, Thermionic Cathode".

BACKGROUND OF THE INVENTION

1. Field of the Invention

This invention relates to hollow cathode plasma switches and switching methods.

2. Description of the Related Art

Solid-state switching devices have previously been developed which include gate-turn-off thyristors and integrated-gate-bipolar-transistors. These devices are capable of rapid switching, low voltage drop and cryogenic operation, and have been used in invertor/converter systems that convert high power from a low to a high DC voltage. However, the solid-state switches must operate at fairly low voltages (less than 1 kV), and their transformer coupling to high voltage outputs is poor at high step-up ratios in excess of 10. They are also subject to catastrophic failure under single over-currents or over-voltages, and cannot operate in high temperature/high radiation environments.

A low pressure plasma opening switch that overcomes these disadvantages of solid-state switches is referred to as the CROSSATRON modulator switch (CROSSATRON is a trademark mark of the Hughes Aircraft Company, the assignee of the present invention). Details of this switch are provided in U.S. Pat. No. 4,596,945, issued June 24, 1986 to R. W. Schumacher et.al., and assigned to Hughes Aircraft Company.

The CROSSATRON switch is a secondary-electron-emitter, cold cathode device that employs a controlled diffuse discharge to both close and open pulsed power circuits at high speed and high repetition frequency, enabling operation at substantially higher voltages and currents than solid-state switches. In addition, the CROSSATRON switch is rugged, fault tolerant and can be cooled cryogenically. However, it typically produces a relatively high forward voltage drop on the order of 500 volts, which makes it unsuitable for low-source voltage applications of less than about 5 kV.

A later plasma switch was developed that retains the advantages of the CROSSATRON switch, but operates with a much lower forward voltage drop (on the order of 20 volts), and higher system efficiency. This device, referred to as a Hollotron switch (Hollotron is a trademark of Hughes Aircraft Company), is described in co-pending U.S. Pat. application Ser. No. 07/406,673, filed Sept. 13, 1989 by Robert W. Schumacher et.al., and assigned to Hughes Aircraft Company. It uses a thermionic hollow cathode discharge to form a dense xenon plasma which provides a low forward voltage drop during conduction. The switch also includes a grid-controlled current interruption feature to provide fast, square-pulse modulation.

A drawback of the aforementioned HOLLOTRON switch is that it relies on geometric expansion of the hollow cathode plasma to provide a sufficiently reduced density for interruption. This approach limits switching to approximately 2 amps of peak current at a current density of about 2 amps/cm$^2$. As the current is increased above this level, the higher plasma density generated in the switch is accompanied by a pinching or area constriction ("filamentation") of the plasma's current-carrying channel, which in turn prevents interrupting the current to open the switch. The inability to interrupt current at the higher current levels is believed to be due to Debye shielding of the interruption voltage in the control grid apertures. Simply constructing larger hollow cathodes or moving the control grid and anode further away from the hollow cathode does not assure larger plasma areas or lower plasma densities, and does not increase the switch's current capacity. The plasma channel which carries the current from the dense plasma formed in the interior of the hollow cathode tends to self-pinch to a small cross-section because the plasma channel exhibits a negative resistance, and because there is a finite inward JxB force from the neutralized electron current flowing in a plasma. The high plasma density limits the current and current density that the switch can handle.

Hollow cathodes were originally developed to replace hot filaments in electron-bombardment ion sources to obtain longer life, higher current, and lower power consumption. A typical hollow cathode developed for use in ion thrusters is described in W. Kerslake, D. C. Byers, and J. F. Staggs, AIAA Paper No. 67-700. 1967. This type of hollow cathode was used in the HOLLOTRON switch described above. Operation of a hollow cathode as a plasma source in the magnetic-field-free region of an ion source is described in D. M. Goebel et.al., "Plasma Studies on a Hollow Cathode, Magnet Multipole Ion Source for Neutral Beam Injection", *Rev. Sci.Instrum.*, Vol. 53, No. 6, June 1982, pp. 810-815. In this case, as in ion thruster geometries, the hollow cathode is used as an electron source to generate a discharge for production of ions and ultimately the formation of an ion beam. The hollow cathode is positioned opposite a negatively biased ion accelerator, and the region between is enclosed by a chamber wall biased at anode potential.

Magnetic fields are typically employed in ion thrusters to improve the ionization efficiency of the discharge. In this application, a secondary ionization region (discharge chamber) is positioned between the hollow cathode plasma source and the beam extraction grid. This region is generally bounded axially by two flat plates which are biased at cathode potential, and bounded radially by an electrode (the anode) which is biased at a positive potential with respect to the hollow cathode. A magnetic field is employed primarily to prevent electrons from proceeding directly to the anode from the hollow cathode plasma without first experiencing energetic collisions with neutral gas atoms and thereby generating additional ionization.

In the ion source described in the Goebel et.al. article, there is no mechanism provided to disperse the highdensity plasma stream from the hollow cathode aperture. The filamented plasma channel from the hollow cathode extended over 20 cm into the ion source. To disperse the pinched plasma stream by collisions and produce a uniform plasma at the ion extraction electrode, the ion source had to be constructed with a length from cathode to ion accelerator of over 40 cm. This long length resulted in significant plasma loss to the anode walls, a relatively high voltage drop of typically six times the ionization potential, and a modest overall efficiency of the device.

The problem of dispersing the plasma stream from a hollow cathode was addressed in the early stages of ion thruster development. In the work described in H. J. King et.al., "Electron-Bombardment Thrusters Using Liquid-Mercury Cathodes", J. Spacecraft and Rockets. Vol. 4, No. 5, May 1967, pp. 599–602, a diverging magnetic field was used in part to spread the plasma from a mercury hollow cathode over a large area at the beam extraction grid. Nevertheless, a non-uniform, strongly peaked-on-axis density profile was produced.

Because electrons emitted from the hollow cathode are electrostatically confined between the cathode and first accelerator grid, and magnetically confined such that radial loss to the anode is impeded, electrons are forced to diffuse radially to the cylindrical anode via collisions and E×B instabilities. Although the increased ionization rate improves discharge efficiency, the long diffusion distance for the ionizing electrons to travel from the axis of the source to the anode tends to result in the non-uniform, strongly peaked-on-axis plasma profile. To eliminate the highly peaked-on-axis plasma profile in ion thrusters, a baffle was placed on axis directly in front of the hollow cathode. The axial magnetic field was retained to provide the electron confinement from the anode and increase the ionization efficiency. The baffle forces the electron discharge to run off-axis to provide increased plasma density at the outer radius of the beam extraction grid, while electron-plasma collisions allow the discharge chamber plasma to fill in the hollow profile downstream of the baffle.

There are several geometries of such ion thrusters in the literature. These are described in an article by H. R. Kaufman, "Technology of Electron-Bombardment Ion Thrusters", included in *Advances in Electronics and Electron Phvsics,* ed. L.Marton, Vol., 36, Academic Press, 1974, pp. 266–373. The shaped magnetic field and baffle combination produce uniform plasma densities at the ion accelerator grid, but raise the discharge voltage from anode to cathode to more than twice the ionization potential. In fact, the baffle geometry is normally optimized to raise the discharge impedance to increase the ionization efficiency.

The general ion source configuration with a hollow cathode and a diverging magnetic field was also investigated at Oak Ridge National Laboratory, and is described in C. C. Tsai et.al., "Plasma Studies on a DuoPIGatron Ion Source", *Rev.Sci.Instrum.,* Vol. 48, No. 6, June 1977, pp. 651–655. To produce uniform plasma over larger areas (10 cm to 30 cm diameter), it was also necessary to insert an on-axis baffle at the hollow cathode aperture and add additional magnetic confinement by surface multipole magnetic fields at the anode wall.

The purpose of the magnetic field in all of these devices is primarily to enhance the ion production rate (discharge efficiency) in the discharge chamber outside the hollow cathode and secondarily to produce a uniform ion current to the acceleration electrode. The magnetic field shape in the baffle region is usually optimized to purposely raise the discharge voltage to several times the ionization potential to increase the ionization efficiency of the discharge.

SUMMARY OF THE INVENTION

The present invention seeks to provide a hollow cathode plasma switch and switching method that retains the advantages of prior switches of this type, but has significantly higher current interruption capability at a low forward-voltage drop.

The invention achieves this goal by imposing a diverging magnetic field between the hollow cathode and the anode to expand the plasma where it passes through the control electrode. This dispersion of the plasma across the control electrode produces a uniform current density such that the total interruptible current can be increased by increasing the grid and anode area. The magnetic field prevents the formation of a high current density plasma stream that inhibits the ability of the control grid to interrupt the current.

Although this magnetic-HOLLOTRON switch configuration may be similar in appearance to the devices described above, the opertion is significantly different. As opposed to ion source technology, the present invention operates with a static gas fill, no baffle at the hollow cathode aperture, and a cathode-to-anode voltage drop that is only slightly larger than the ionization potential. The electric field in the device that causes the electrons to flow from cathode to anode is parallel to the magnetic field. Therefore, the applied magnetic field serves only to guide the electrons from the dense plasma in the interior of the hollow cathode to the anode in such a way to distribute the current uniformly over the anode area.

Unlike ion-thruster technology, the magnetic field configuration in this invention is not used to confine the primary electrons extracted from the hollow cathode to increase the ionization probability before collection at the anode. Plasma generation in the HOLLOTRON switch occurs primarily in the hollow cathode where the primary electrons are electrostatically confined. The magnetic field guides electrons from the hollow cathode plasma directly to the anode, and actually reduces the ionization rate outside the hollow cathode by reducing the electron path length. This guiding function significantly reduces the highly-peaked-on-axis plasma density profile reported in the prior art, and provides a uniform plasma density at the control grid without the use of a baffle. Elimination of the baffle or other restrictions in the plasma stream between the cathode to the anode (such as keep-alive grids) provides the desired low-forward-voltage drop in the switch. The magnetic field shape is selected to optimize the electron current interruption capability of the switch by producing a uniform, controlled current density to the control grid.

In a particular implementation, the Xe gas pressure is less than about 0.1 Torr and preferably about 0.06 Torr, the cathode to control grid spacing is about 5 cm and preferably about 3.5 cm, and the magnetic field strength is at least 150 Gauss and preferably about 200 Gauss. The mesh aperture size of the grid in the control electrode passageway is selected to be less than 0.3 mm in diameter to reduce the required negative bias on the control grid to less than 250 V to achieve interruption. With these parameters, the switch produced total peak current pulses in excess of 20 A, which is an order of magnitude higher than the HOLLOTRON prior art, at current densities at the control grid of over 3.3 A/cm$^2$. Peak current pulses of 12 A at current densities of 2 A/cm$^2$ have been achieved with a forward voltage drop of only 20 V, and closing and opening times of less than 0.3 $\mu$sec.

These and other features and advantages of the invention will be apparent to those skilled in the art from the following detailed description, taken together with the accompanying drawings, in which:

BRIEF DESCRIPTION OF THE DRAWINGS

FIG. 3 is a graph which plots the plasma magentization as a function of applied magnetic field electrical schematic diagram

Figure 8:
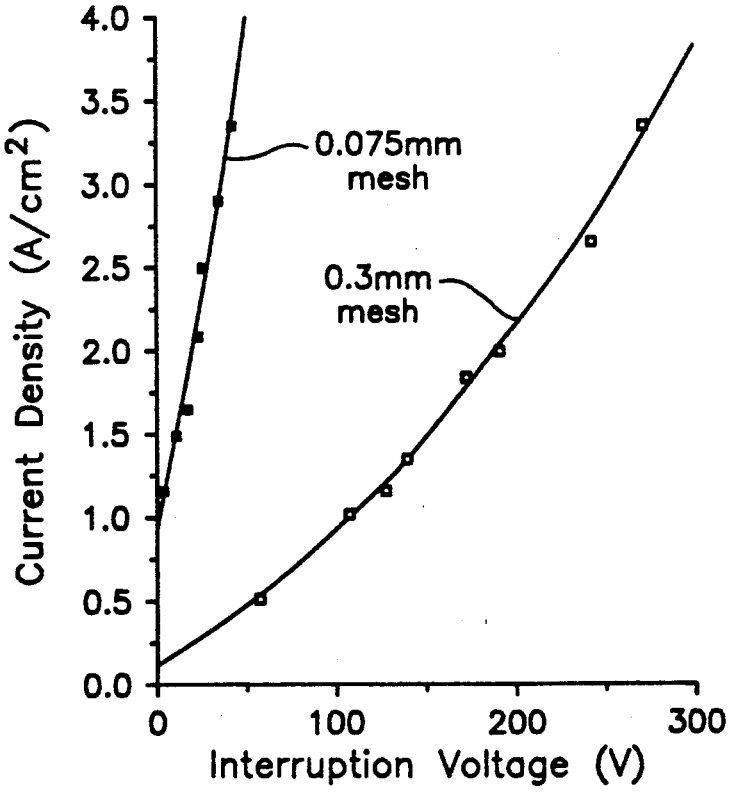
Figure 9:
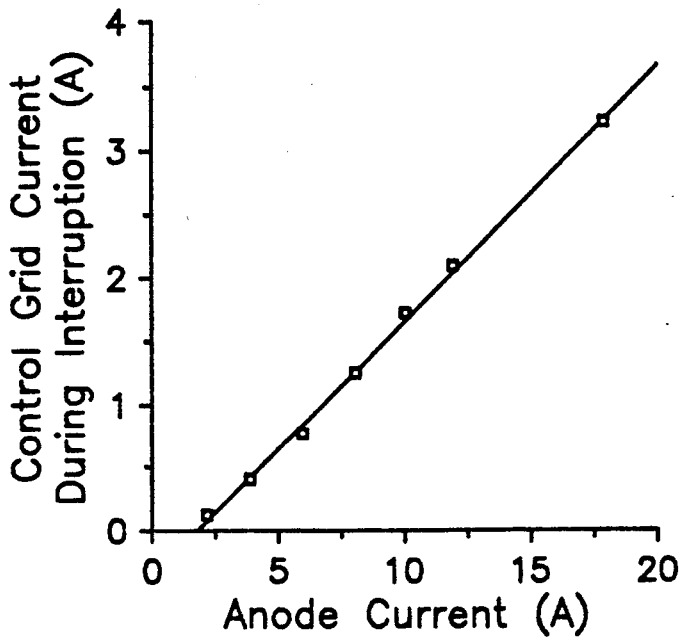
Figure 10:
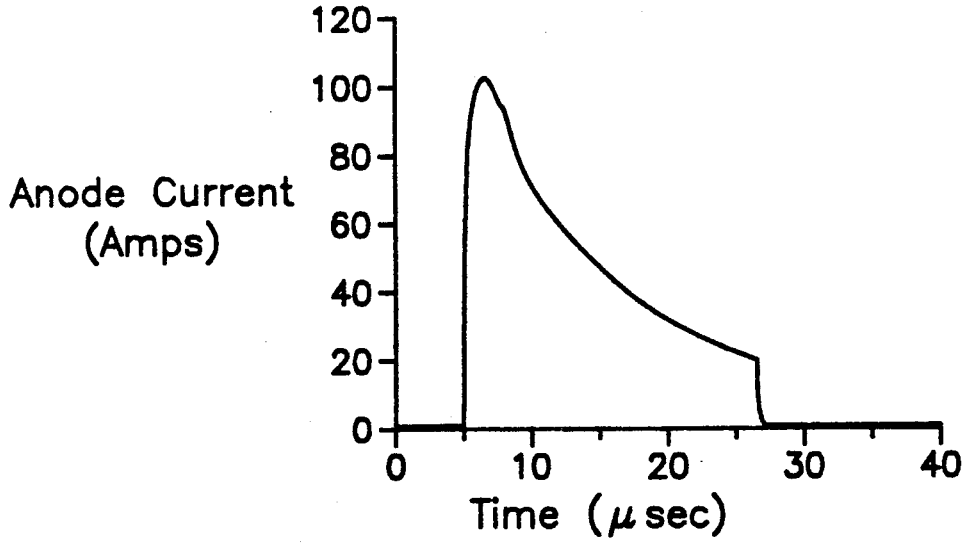

FIGS. *7a* and *7b* are graphs of the closing and opening responses achieved with the invention;

FIG. 8 is a graph of current density plotted against interruption voltage for different control electrode mes sizes;

FIG. 9 is a graph of the control electrode current during interruption plotted against anode current; and FIG. 10 is a graph plotting the anode current as a function of time during switch closing and opening operations.

DETAILED DESCRIPTION OF THE INVENTION

In the improved HOLLOTRON plasma switch described herein, the plasma is forced to expand uniformly to larger areas by imposing a diverging magnetic field upon the plasma column. A magnetized HOLLOTRON plasma switch that demonstrates the invention is shown schematically in FIG. 1. The switch will be described with specific dimensions and parameters used for a demonstration unit, but these specific quantities can be varied and should not be taken as limiting. The switch is enclosed within a pressure housing 14, with a xenon gas source 16 attached to the housing via a valve 18. A 0.64 cm inner diameter, Ba oxide impregnated hollow cathode 20 is heated by a sheathed tantalum heater 22. Heating current is supplied through an electrical feedthrough 24. Electrons emitted from the hollow cathode 20 form the plasma by collision with the gas particles inside the housing in the vicinity of the cathode.

A keep-alive electrode 26 having a truncated cone shape, with an opening in the truncated portion for the passage of plasma, is placed just outside the hollow cathode exit to maintain a plasma near the cathode exit before the switch is operated. Prior plasma switches such as the HOLLOTRON and CROSSATRON devices employed planar grid keepers, although a similar cone-shaped keeper has been used previously in a hollow cathode ion source. This geometry provides the keeper current required to reduce switch jitter without imposing the restriction on the plasma column that results from locating a grid or solid disk directly in the plasma.

A seven-turn coil 28 around the keeper support tube establishes a magnetic field having lines of force that diverge outward from the hollow cathode 20. The coil produces 2.8 gauss/A, as measured at the keeper cone location. The establishment of this magnetic field resulted in a significant increase in the switch's current capacity, and is a critical aspect of the invention that is discussed in more detail below.

A control electrode 30 is positioned 3.5 cm from the hollow cathode 20. The control electrode consists of a 7.7 cm diameter stainless-steel disk with a 2.8 cm diameter passageway. A stainless-steel grid 32 with 0.3 mm mesh apertures is spot-welded over the passageway. The control electrode 30 is mounted on a cylinder 34 of the same mesh material, which in turn is supported by ceramic standoffs. Current is supplied to the coil 28 through a feedthrough 36, while appropriate voltage potentials are applied to keeper 26 and control electrode 30 via standoffs 38 and 40, respectively.

A conductive anode 42 is positioned 2 mm from the opposite side of the control electrode 30 from the hollow cathode 20. In operation, the anode is kept at a positive voltage relative to the cathode. The plasma extends all the way from the cathode to the anode and conducts current between the two in response to a positive voltage pulse on the control electrode; a negative control voltage pulse interrupts the current flow and causes the plasma to withdraw back to the keeper area.

Figure 2:
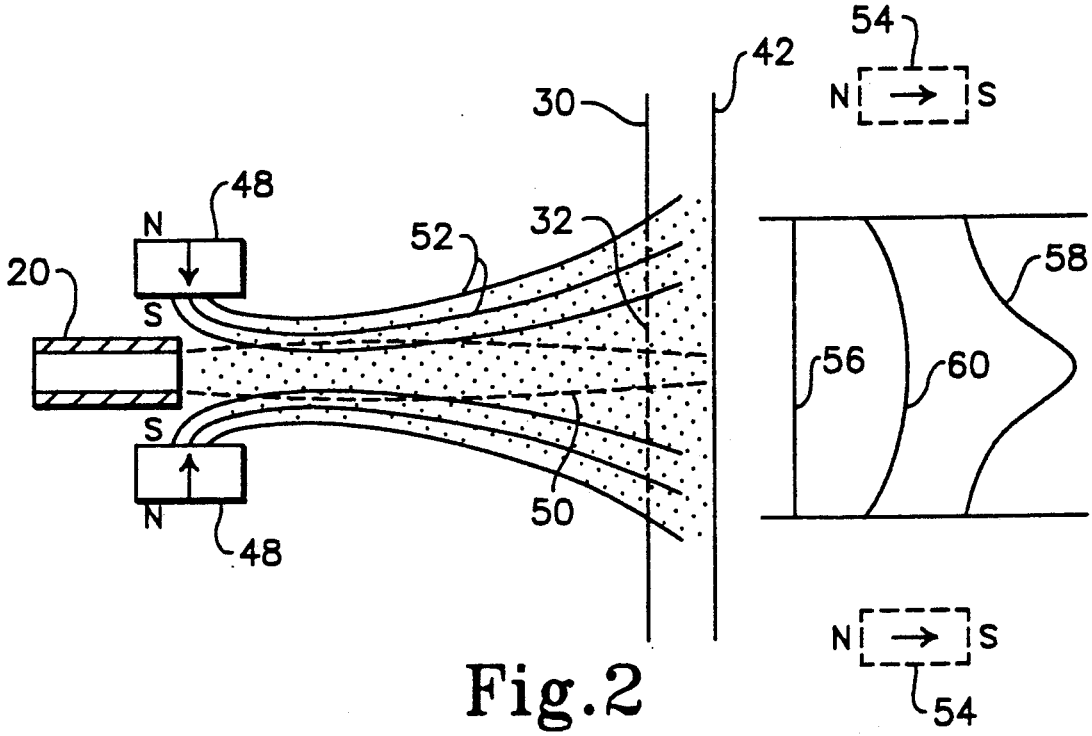
FIG. 2 is a diagram illustrating the operation of the invention.

The operation of the switch when it is turned on and conducts current between the cathode and anode is illustrated in FIG. 2. In this illustration, magnetic field coil 28 has been replaced by a permanent ring magnet 48; either electromagnets or permanent magnets could be used, so long as they establish the requisite divergent magnetic field.

The prior HOLLOTRON switch, which did not employ a divergent magnetic field, was capable of switching about 2 amps of peak current for a current density at the control electrode of approximately 2 amps/cm$^2$. As the current was increased above this level, the plasma stream (the outer boundaries of which are indicated by dashed lines 50) tended to constrict at the control electrode and anode, and also to wobble about at its outer end. The increase in plasma density prevented interruption of the current by Debye shielding the interruption voltage in the control grid 32 apertures.

In the present invention, a magnetic field (indicated by field lines 52) which diverges between the hollow cathode 20 and control grid 32 forces the plasma to spread across a wider area at the control grid. With a proper setting for the magnetic field strength and other parameters of the switch, the plasma can be forced to spread substantially across the entire control electrode passageway defined by grid 32; this expanded plasma volume is indicated by stippling in FIG. 2. If desired, optional magnets 54 or simple iron masses can be positioned behind and lateral to the control electrode passageway to assist in shaping the divergent magnetic field.

It is desirable that the electron distribution within the plasma at the control electrode passageway be fairly uniform, to maximize the interruptible current. In general, about 95% of the current between the cathode and anode will be carried either by primary electrons emitted from the cathode or secondary electron resulting from ionizing collisions between primary electrons and gas molecules. An electron density distribution that is quite flat, as illustrated by distribution plot 56 to the right of the control electrode 30 and anode 42 in FIG. 2, can be achieved if the plasma is established such that a large number of electrongas molecule collisions occur. However, a large number of such collisions increases the switch's forward voltage drop, thus degrading one of the primary advantages of a hollow cathode. If, on the other hand, the plasma is established such that there are very few collisions, the electron density distribution will have a distinct peak near the center of the control electrode grid, as illustrated by electron density plot 58. This is also undesirable, since it reduces the amount of current that can be interrupted. An intermediate situation, in which there are some but relatively few collisions with a small degradation in both current interruption capacity and forward voltage drop, is generally desirable. The electron density distribution for the desired plasma configuration is illustrate by plot 60, which is gently rounded and avoids the sharp peak of plot 58.

The two most important determinants of the number of electron-gas molecule collisions are the gas pressure within the pressure housing, and the distance between the hollow cathode 20 and the control electrode grid 32 (electron energy is a second order factor). In essence, the selection of these elements involves a trade-off between forward voltage drop and current interruption capability, such that neither is seriously degraded. The cathode-control electrode spacing is also related to the shape of the magnetic field; the spacing can generally be reduced as the field becomes more divergent. Preferred pressure and spacing ranges are discussed below.

The value of the magnetic field required to expand the plasma can be calculated from electron diffusion theory. In this theory, electrons migrate across an applied magnetic field by random-walk collisions with the neutral gas. The perpendicular diffusion coefficient for electron motion across the magnetic field is given by $$D_p = \frac{D}{1 + \omega_c^2 t^2}$$

where D is the normal coefficient for electron diffusion in the plasma, $\omega_c$ is the electron cyclotron (orbital) frequency and t is the electron-neutral collision period, which depends upon the neutral gas pressure. When the quantity $\omega_c^2 t^2$ is much greater than unity, the electrons are magnetized and follow the magnetic field lines. This equation basically states that the magnetic field is effective in controlling the electron dispersion when the electrons perform many cyclotron orbits before a collision with the neutral gas allows them to move to the next magnetic-field line. A plot of $\omega_c^2 t^2$ in xenon versus the applied magnetic field, for four different gas pressures, is shown in FIG. 3.

Figure 1:
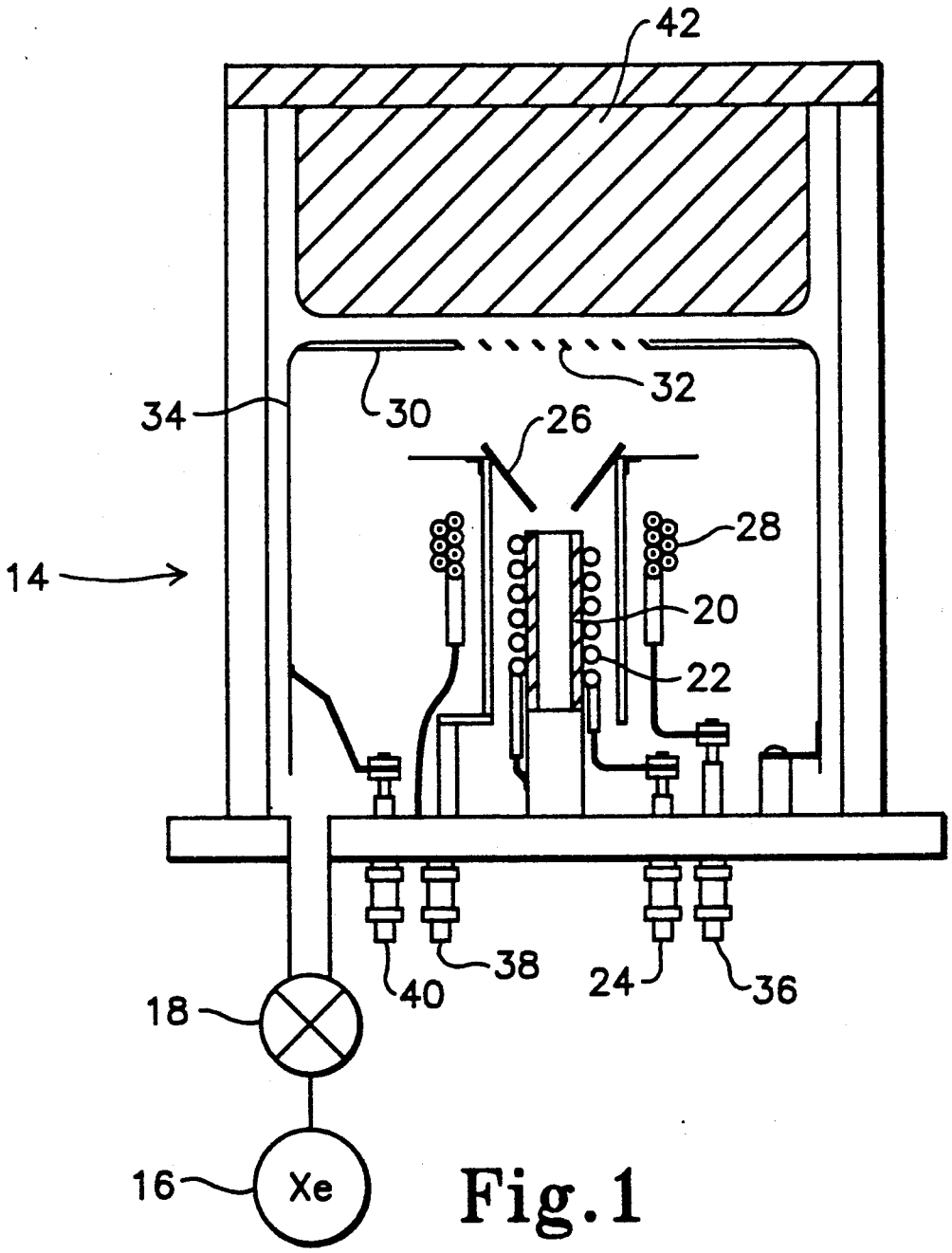
FIG. 1 is a schematic view of a modified HOLLOTRON switch that incorporates the present invention.
Figure 3:
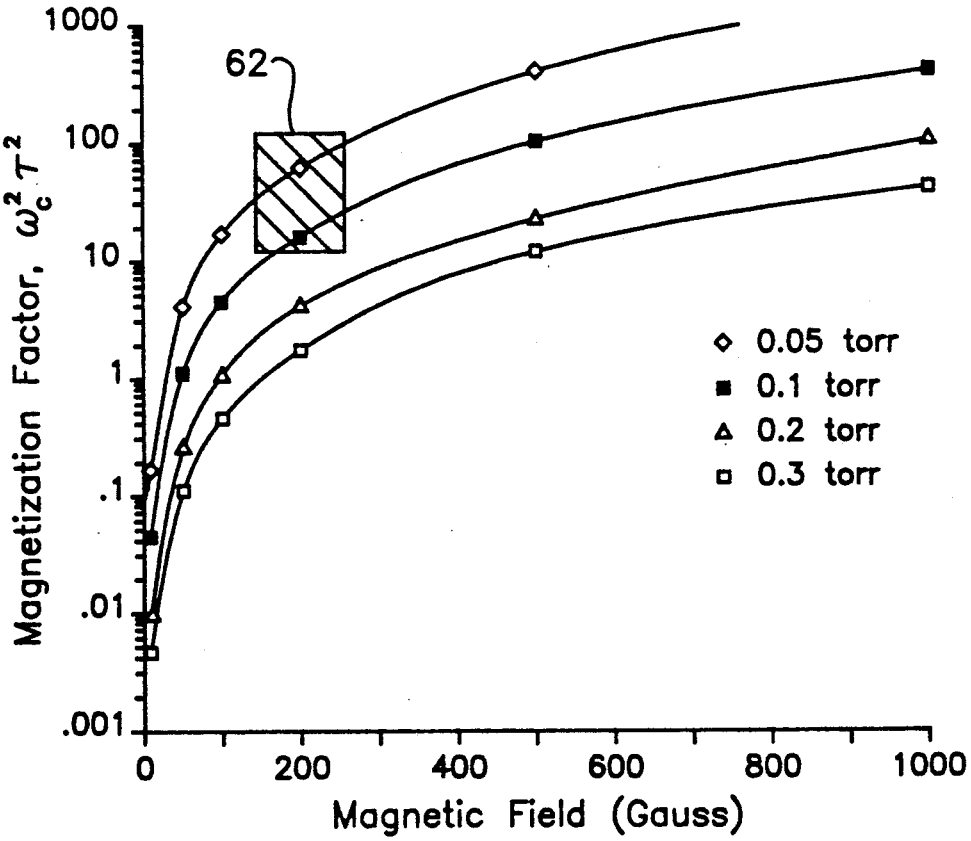
FIG. 3 is a graph which plots the plasma magnetization as a function of applied magnetic field for different pressures.
Figure 4:
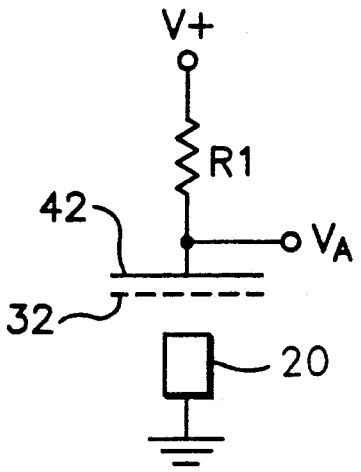
FIG. 4 is a simplified electrical schematic diagram showing a test set-up for the switch.

The apparatus of FIG. 1 was operated experimentally in the region shown by the hatched square 62 in FIG. 3. At magnetic fields below 150 gauss, the plasma was not well magnetized and the plasma column because visually more constricted. In this case, the maximum current that could be interrupted was about 4 amps. Likewise, at pressures above 0.1 torr the magnetic field was found to have no effect on the plasma shape due to the high collision rate. The preferred pressure and magnetic field for the new plasma switch were found to be about 0.06 torr and about 200 gauss. Within these parameters, the spacing between the hollow cathode and control electrode grid of about 2–5 cm, and preferably about 3.5 cm, will produce a smoothly rounded electron density distribution at the control grid, as illustrated by curve 60 in FIG. 2. Within these parameters the ions are unmagnetized, and with sufficient electron-neutral collisions the plasma is unmagnetized very near the control grid. This causes the plasma to become more uniform (via collisions and diffusion) at the control grid than if the plasma were absolutely restricted to the diverging magnetic lines of force.

The present plasma switch has produced 5 kV, 12 amp square pulses at 2 amp/cm$^2$ peak anode current density, with a 50% duty cycle and 20 kHz pulse repetition frequency. A simplified electrical schematic of the set-up is given in through resistor R1; the anode voltage taken at terminal $V_A$. The hollow cathode 20 was grounded, and control pulses with durations of about 1.5 microsecond were applied to the control electrode grid 32.

Figure 5:
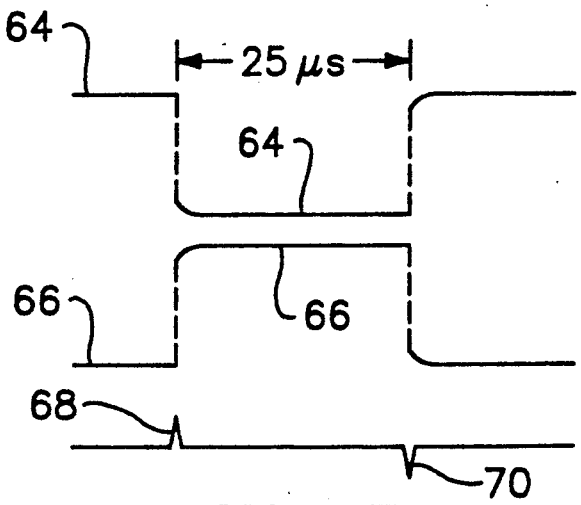
FIG. 5 is a graph showing the response of the plasma switch to applied control pulses.

An oscillograph trace of the waveform of a single, 25 microsecond wide pulse with the above parameters is shown in FIG. 5. The upper trace 64 is of the anode voltage, which dropped rapidly from 5 kV to ground when th switch was closed. The lower trace 66 shows the anode current, which rose rapidly to 12 amps when the switch was closed. The switch was closed by a voltage pulse 68 applied to the control electrode grid, and opened 25 microseconds later by a negative pulse 70 applied to the grid. Bursts of 4 pulses and 10 pulses at 50% duty were also demonstrated, and produced anode voltage and current pulses that were very square and reproducible. There was no indication of any limit to the switch pulsing capability.

Figure 6:
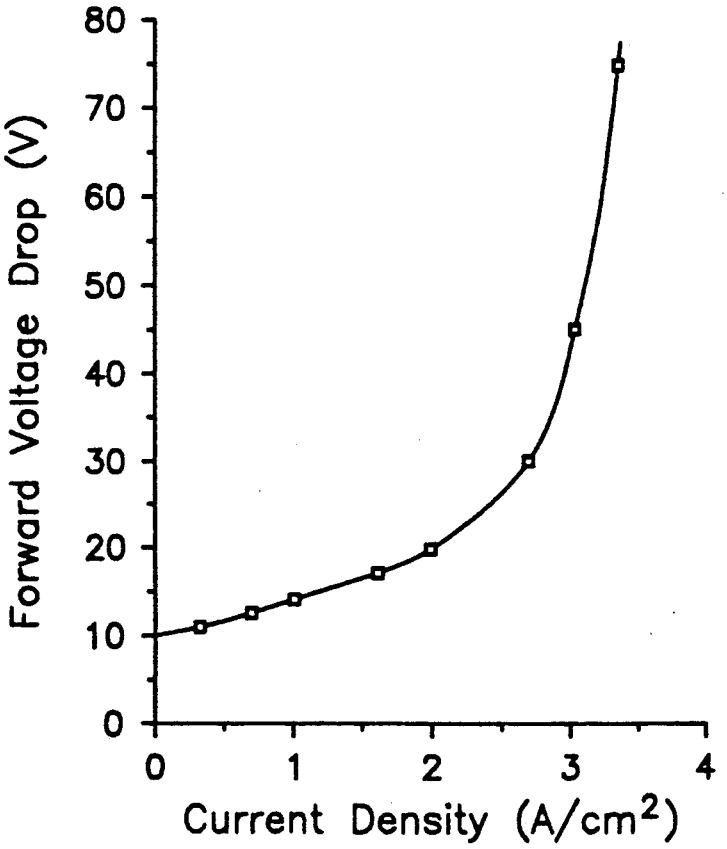
FIG. 6 is a graph of the switch's forward voltage drop as a function of current density for one implementation of the invention.

The 12 amp, 2 amp/cm$^2$ current density pulses were achieved with a measured forward voltage drop from cathode to anode of only 20 volts. The forward voltage drop is considered low if the value is less than twice the ionization energy of the gas, or less than 24V for xenon. The forward voltage drop during operation at 0.055 torr and 200 gauss increased with the anode current density, as shown in FIG. 6. Increasing the gas pressure lowered the forward voltage drop for all current levels. The rapid increase in the forward voltage drop at current densities higher than 2.5 amps/cm$^2$ appears to be indicative of space charge limiting of the current flow in the hollow cathode aperture. A potentially beneficial application of this effect is in limiting the peak current capability of the invertor switch during faults. To keep the forward voltage drop fairly low, it is generally preferable to operate at current densities no greater than about 3 amps/cm$^2$.

Figure 7A:
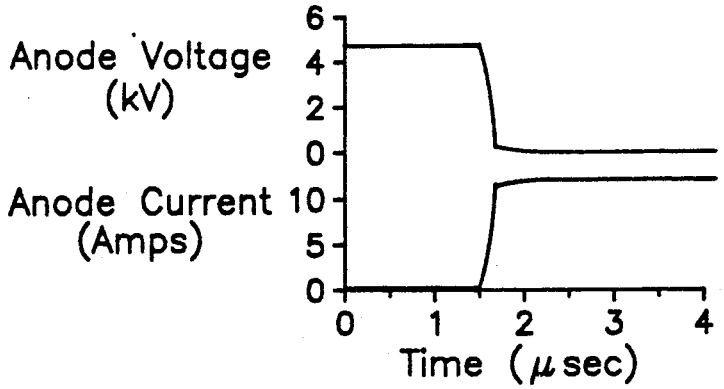
Figure 7B:
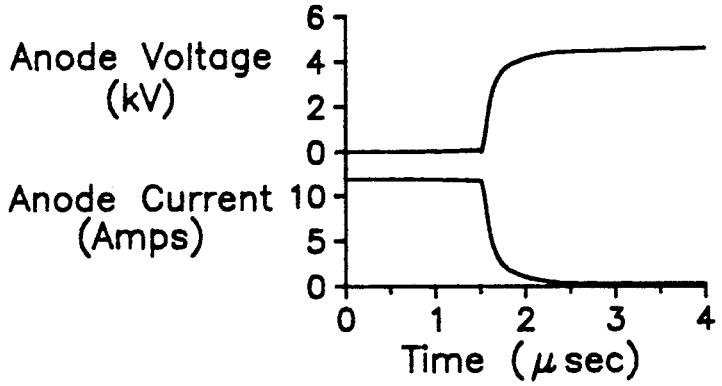

The closing and opening performances of the switch are shown in FIGS. *7a* and *7b*, respectively. The rise time of the switch current at 2 amps/cm$^2$ was about 0.2 μsec. The upper trace shows the anode voltage and the lower trace shows the anode current as a function of time. The control grid bias voltage, not shown in FIG. 7, was typically pulsed positive to 150 volts for a period of about 1.5 microseconds. After a delay of several hundred nsec, the control grid voltage decreased rapidly to near the forward drop as the control grid current passed through a 10 ohm current-limiting resistor.

The switch's opening time at 2 amps/cm$^2$ was about 0.3 μsec, and varied strongly with the gas pressure and negative bias control grid voltage, which was −220 volts. Reducing the negative bias increased the interruption time until the switch failed to interrupt.

The maximum current density that could be reliably interrupted at a xenon pressure of 0.06 torr is plotted in FIG. 8 as a function of the negative control grid interruption voltage and the mesh size of the control grid 32. Square pulses at currents of up to 20 amps, corresponding to current densities of 3.3 amps/cm$^2$, were generated reliably by using negative control grid potentials of 270 volts.

The control grid mesh size can be adjusted to reduce the required negative bias, which in turn can reduce the sputtering of the grid and increase the switch life. FIG. 8 is a plot of the plasma current density against a required control grid interruption voltage for control grids with 0.3 mm and 0.075 mm mesh openings. It was found that the negative control grid bias can be reduced to less than 50 volts with a mesh aperture size of 0.075 mm. Reducing the negative grid bias voltage below 50V eliminates control grid sputtering because the Xe sputtering threshold is about 50V for most grid materials; this greatly extends the switch lifetime. While the 0.075 mm mesh aperture size increases the closing time of the switch compared to a 0.3 mm mesh, the switch can still be olosed in less than 1 μsec.

The power loading and sputtering of the control grid is also determined by the current which it collects during interruption. The peak current collected by the control grid is plotted against the total anode current in FIG. 9. It can be seen that the control grid collects only about 20% of the anode current. This is significantly less current than that collected by a CROSSATRON switch control grid during interruption. With a CROSSATRON switch, half the current is carried by ions, and the control grid must collect a peak current during interruption that is nearly equal to the anode current. The control grid of the present switch collects significantly less current because the switch current is carried primarily by electrons. The plasma density at the control grid is much lower than in CROSSATRON switches, and the available ion current is accordingly reduced. Measurements indicate that this peak current is collected for less than half the interruption time. The low control grid current and short collection time results in a significant reduction in the control grid power loading, compared to CROSSATRON switches.

For a molybdenum control grid, the grid lifetime for an interruption voltage of 100 volts can be calculated at about 1,030 hours. For longer grid life, the grid erosion can be virtually eliminated by reducing the interruption voltage to about 50 volts. The threshold for xenon sputtering of molybdenum is 49.3 eV, below which no sputtering occurs and the grid life is virtually infinite. The sputtering yield increases rapidly as the ion energy increases above this value. From the data of FIG. 8, operating with control grid mesh apertures less than 0.15 mm and current densities between 1 and 2 amps/cm$^2$, the erosion limited switch life can be increased to over 10,000 hours. In this case, the switch life would probably be limited by the hollow cathode.

The present switch will usually be required to supply and interrupt currents in excess of the normal levels to switch transients during closing and fault conditions. The experimental switch described above achieved a 100 amp closing current at a 0.055 torr xenon pressure and 200 gauss magnetic field. This current was limited only by breakdown on the unshielded electrical feedthroughs at the base of the switch during the high density plasma generation. During these tests, the switch also interrupted a current of 20 amps, corresponding to a current density of 3.3 amps/cm$^2$. This highly desirable performance is displayed in FIG. 10, which shows the anode current as a function of time for the switch closing 100 amps and opening 20 amps.

The present invention adds a diverging magnetic field to the HOLLOTRON switch, but without the electron trapping in the anode-cathode gap characteristic of ion source plasmas. Electrons are not reflected at the boundary opposite the cathode so that the electron density does not build up on-axis; the plasma profile is therefore not strongly peaked on-axis. The flattening of the plasma profile allows the elimination of the baffle in front of the hollow cathode, which in turn reduces the discharge impedance to less than twice the ionization potential, lowered the operating gas pressure, and reduced the forward voltage drop. Spreading of the electron current over a broad area at the control electrode with a diffuse profile allows the interruption of high total peak currents.

In addition to a substantially reduced grid power loading and forward voltage drop compared to CROSSATRON switches, the present plasma switch demonstrated a significantly higher current carrying capacity than prior HOLLOTRON switches; the increase is from the 2 amp range to tens and even hundreds of amps. While an illustrative embodiment of the invention has been shown and described, numerous variations and alternate embodiments will occur to those skilled in the art. Such variations and alternate embodiments are contemplated, and can be made without departing from the spirit and scope of the invention as defined in the appended claims.

I claim:

1. A low forward-voltage drop, high current plasma switch, comprising:

a hollow cathode for emitting electrons to form a plasma, an anode spaced from the hollow cathode for receiving current from the hollow cathode through the plasma when the switch is on, a control electrode between the hollow cathode and the anode for controlling the reach of the plasma from the hollow cathode towards the anode, said control electrode including a plasma passageway which is larger than the area of the plasma at the control electrode for plasma currents above a threshold current level, and means for forming a diverging magnetic field between the hollow cathode and the control electrode to expand the spread of the plasma at said passageway for plasma currents above said threshold level.

2. The plasma switch of claim 1, wherein the magnetic field strength is at least about 150 gauss.

3. The plasma switch of claim 2, further comprising a pressure housing enclosing said switch, and an ionizable gas within said pressure housing, said pressure housing maintaining said gas at a pressure less than about 0.1 torr.

4. The plasma switch of claim 3, wherein the magnetic field strength and gas pressure are on the order of 200 gauss and 0.06 torr, respectively.

5. The plasma switch of claim 4, wherein said control electrode is spaced on the order of 2–5 cm. from said hollow cathode.

6. The plasma switch of claim 4, wherein the plasma current density is maintained at less than about 3.5 amps/cmz

7. The plasma switch of claim 1, said control electrode passageway comprising a mesh having a mesh aperture size of not more than about 0.3 mm.

8. The plasma switch of claim 7, wherein said mesh aperture size is not more than about 0.075 mm.

9. The plasma switch of claim 1, said control electrode passageway comprising a mesh, the aperture size of said mesh and the plasma current density at the passageway being selected to keep the control electrode interrupt voltage necessary to interrupt the flow of switch current at not more than about 50 volts.

10. The plasma switch of claim 1, further comprising a truncated conical keeper between the hollow cathode and the control electrode for maintaining a plasma in the vicinity of the hollow cathode, said keeper having an opening in its truncated portion for the passage of plasma between said hollow cathode and said control electrode.

11. A low forward-voltage drop, high current plasma switch system, comprising:

a pressure housing, an ionizable gas within said housing, a hollow cathode within said housing for emitting electrons to form a plasma from said gas, an anode spaced within said housing from the hollow cathode for receiving current from the hollow cathode through the plasma, a control electrode within the housing between the hollow cathode and the anode for controlling the reach of plasma from the hollow cathode to the anode, said control electrode including a plasma passageway, means for applying control voltage signals to said control electrode for initiating and interrupting the flow of current through said plasma between the hollow cathode and the anode, means for forming a diverging magnetic field within the housing to spread said plasma across said passageway, and means setting the pressure within said housing at a level that establishes a rounded plasma electron density distribution plot across said passageway.

12. The plasma switch system of claim 11, wherein said pressure setting means sets the pressure within said housing at no more than about 0.1 torr.

13. The plasma switch system of claim 12, wherein the magnetic field strength is at least about 150 gauss.

14. The plasma switch system of claim 13, wherein the magnetic field strength and gas pressure within said housing are on the order of 200 gauss and 0.06 torr, respectively.

15. The plasma switch system of claim 14, wherein the plasma current density at said control gate electrode passageway is maintained at less than about 3.5 amps/cm$^2$.

16. The plasma switch system of claim 12, wherein said control electrode is spaced on the order of 2–5 cm. from said hollow cathode.

17. The plasma switch system of claim 11, said control electrode passageway comprising a mesh having a mesh aperture size of not more than about 0.3 mm.

18. The plasma switch of claim 17, wherein said mesh aperture size is not more than about 0.075 mm.

19. The plasma switch of claim 11, said control electrode passageway comprising a mesh, the aperture size of said mesh and the plasma current density at the passageway being selected to keep the control electrode interrupt voltage necessary to interrupt the flow of switch current at not mor than about 50 volts.

20. The plasma switch of claim 11, further comprising a truncated conical keeper between the hollow cathode and the control electrode for maintaining a plasma in the vicinity of the hollow cathode, said keeper having an opening in its truncated portion for the passage of plasma between said hollow cathode and said control electrode.

21. A method of switching an electrical circuit, comprising:

providing a pair of switch terminals in said electrical circuit to close the circuit when the terminals are electrically connected, and to open the circuit when the terminals are electrically disconnected, establishing a plasma from a hollow cathode connected to one of said terminals, controlling the reach of said plasma from said hollow cathode towards an anode connected to the other of said switch terminals to respectively close and open the circuit when the plasma does and does not reach all the way from said hollow cathode to said anode, the cross-sectional area of said plasma at the anode being constricted above a threshold plasma current level to limit its current interruption capacity, and applying a diverging magnetic field to expand the spread of said plasma between said hollow cathode and said anode, and thereby increase its current interruption capacity.

22. The method of claim 21, wherein the magnetic field strength is at least about 150 gauss.

23. The method of claim 22, wherein said plasma is formed from a gas that is maintained at a pressure less than about 0.1 torr.

24. The method of claim 23, wherein the magnetic field strength and gas pressure are on the order of 200 gauss and 0.06 torr, respectively.

25. The method of claim 24, wherein the reach of said plasma between said hollow cathode and anode is controlled applying a voltage to a control electrode positioned between the hollow cathode and anode on the order of 3–4 cm. from the hollow cathode, said control electrode including a plasma passageway.

* * * * *

UNITED STATES PATENT AND TRADEMARK OFFICE

CERTIFICATE OF CORRECTION

PATENT NO. : 5,132,597

DATED : JULY 21, 1992

NVENTOR(S) : DAN M. GOEBEL, et al.

It is certified that error appears in the above-identified patent and that said Letters Patent is hereby corrected as shown below:

Col. 10, line 63, delete "amps/cmz" and insert --amps/$cm^2$--.

Col. 11, line 49, delete "gate".

Col. 12, line 11, delete "mor" and insert --more--.

Col. 12, line 50, after the word "trolled", insert --by--.

Signed and Sealed this

Sixteenth Day of November, 1993

Bruce Lehman

*Attest:*

BRUCE LEHMAN

*Attesting Officer*

*Commissioner of Patents and Trademarks*